United States Patent [19]

Drews

[11] 4,061,002

[45] Dec. 6, 1977

[54] MOTOR SHIELD FOR APPLIANCE

[75] Inventor: Reinhold Alvin Drews, Stevensville, Mich.

[73] Assignee: Whirlpool Corporation, Benton Harbor, Mich.

[21] Appl. No.: 670,119

[22] Filed: Mar. 25, 1976

[51] Int. Cl.[2] ..... D06F 37/00

[52] U.S. Cl. ..... 68/212; 134/201

[58] Field of Search ..... 310/88, 51, 85, 89, 310/91, 66, 157; 68/23.3, 23.7, 212; 134/183, 182, 184, 186, 188, 201; 248/15, 18

[56] References Cited

U.S. PATENT DOCUMENTS

| | | | |
|---|---|---|---|
| 2,732,724 | 1/1956 | Tateishi | 310/51 |
| 2,959,966 | 11/1960 | Bochan | 68/23.3 |
| 3,031,564 | 4/1962 | Levit | 134/184 |
| 3,137,467 | 6/1964 | Khan | 248/18 |

FOREIGN PATENT DOCUMENTS

| | | | |
|---|---|---|---|
| 561,490 | 4/1957 | Italy | 68/23.3 |
| 390,859 | 8/1965 | Switzerland | 68/23.3 |

*Primary Examiner*—R. Skudy

*Attorney, Agent, or Firm*—Hill, Gross, Simpson, Van Santen, Steadman, Chiara & Simpson

[57] ABSTRACT

A formed cover is attached to motor mounting studs for overlying an electric motor of an appliance such as an automatic washer. The cover has raised perimeter wall portions about flat liquid collection zones, spillways formed through the wall portions at selected corner locations, and drip lips subjacent the spillways to direct spilled liquid away from said motor. From one side of the cover a flexible drape is hung alongside the motor to protect vital motor control components from liquid splashes. A central portion of the cover is raised and open to permit cooling air passage along the motor shaft and through the cover.

11 Claims, 5 Drawing Figures

MOTOR SHIELD FOR APPLIANCE

BACKGROUND OF THE INVENTION

1. Field of the Invention

The present invention relates generally to liquid control and shielding devices for electric appliances.

2. Description of the Prior Art

In an appliance such as an automatic washer which includes a liquid receptacle in addition to an electric motor and related electrical components, it is important to prevent liquid which may escape from the liquid receptacle from contacting the motor or any other such electrical components of the appliance and causing damage thereto or creating an electric shock hazard as a result of such contact. Prior devices of the assignee of the present application have employed a generally U-shaped cardboard shield adjacent the top, the bottom, and one side of the motor, to protect the motor from water spillage. In another version a flat sheet of cardboard was bent to fit over the top of the motor together with a flexible drape mounted along one side of a base plate of the machine but about 18 inches from a side of the motor. U.S. Pat. No. 2,743,385 discloses a metal canopy including downturned side portions for preventing the entrance of rain or other dripping water or foreign material into ventilating openings of a motor. U.S. Pat. No. 3,525,241 shows, in FIG. 1, in a washing machine a tray with an upwardly-extending circumferential wall above a motor housing, the tray including a spout for directing liquid collected in the tray away from the motor.

SUMMARY OF THE INVENTION

A molded plastic shield is attached above the motor of an appliance such as a washing machine and upon motor mounting studs adjacent the motor mounting bracket. The shield acts as a cover over the motor and shields the motor from liquid which may splash, spill, or overflow from a liquid receptacle above the motor. The invention also provides for a flexible drape to be mounted or hung adjacent one side of the motor from the shield and two of the motor mounting studs. The drape primarily prevents liquids from splashing up from the floor onto the motor and also prevents liquid from running down onto the side of the motor where a centrifugal switch and other control devices may be exposed. The motor shield also provides clip means for directing and retaining electric wires from the motor adjacent the shield and an air passage formed in the shield for allowing air to flow along the motor shaft.

DESCRIPTION OF THE PREFERRED EMBODIMENT

Figure 1:
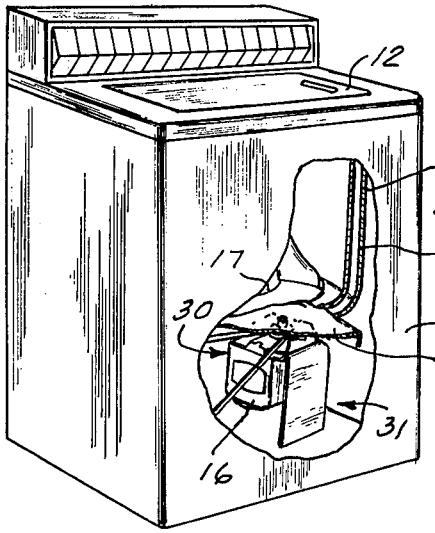
FIG. 1 is a general persective view of an automatic washing machine with part of the cabinet and internal parts cut away to show placement of the device of the present invention above the motor near the rear of the cabinet.

A laundry appliance in the form of an automatic washer of the vertical axis type is shown generally at 10 in FIG. 1. The washer 10 comprises a cabinet 11 having a door 12 which may be opened for access into a washing receptacle comprising a tube 13 and a perforated clothes basket 14 affixed coaxially therewith. Both the tub 13 and the basket 14 are open at the top, and the tub 13 has water inlet means and drainage means (not shown) for filling and draining wash liquid to and from the washing zone. Located generally beneath the washing receptacle upon a frame 15 is an electric motor 16 which provides oscillatory movement to an agitator 17 within the clothes basket 14 for washing, and high speed rotational movement to the tub 13 for centrifuging during liquid extraction.

Figure 2:
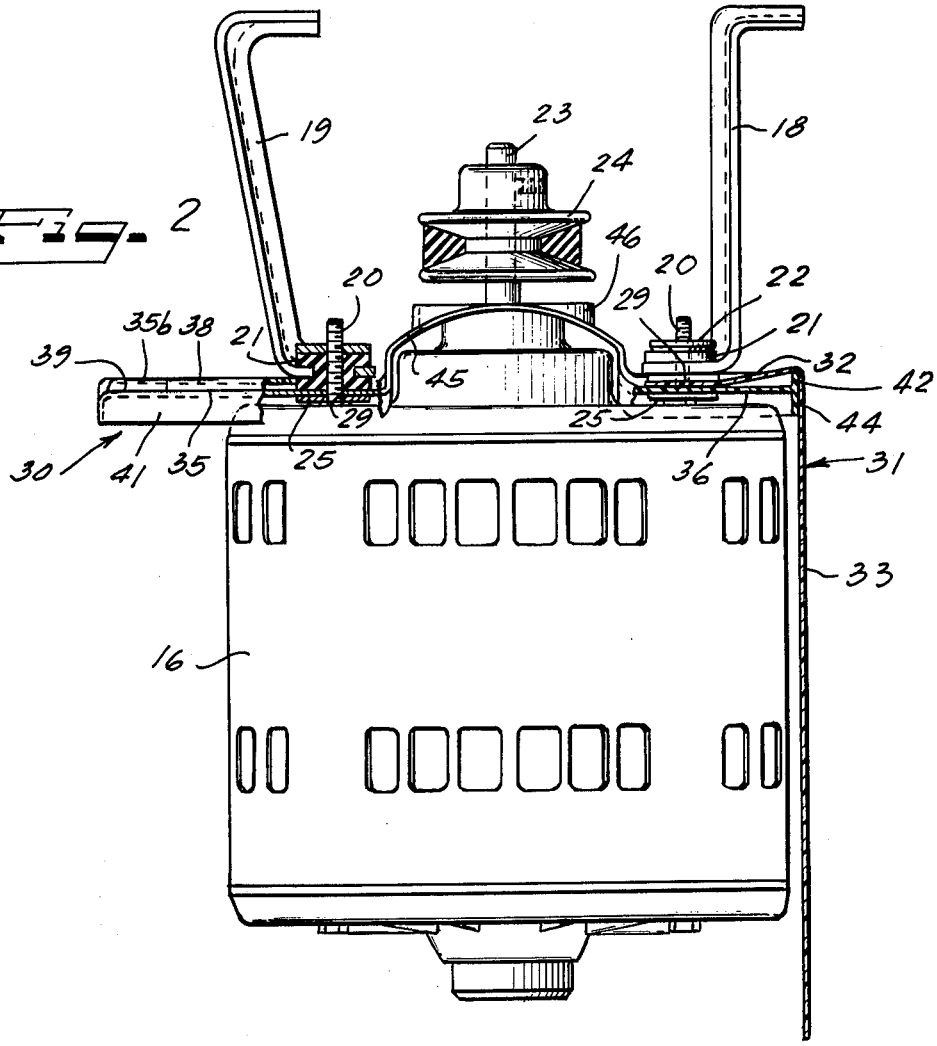
FIG. 2 is an end view, partially in section, of the drip shield as installed upon a motor between the motor and its mounting bracket.

As best shown in FIG. 2, the motor 16 is affixed to the frame 15 upon mounting brackets 18, 19 which engage the casing of the motor 16 via studs 20 thereon. The motor mounting studs 20 are connected to the brackets 18, 19 through rubber grommets 21, which help to isolate the brackets 18, 19 and the frame 15 from vibrations of the motor 16, and are secured by means of nuts 22. In the embodiment shown, a motor output shaft 23 extends vertically upwardly between the mounting brackets 18, 19 and receives a motor pulley 24 thereupon. The motor 16 as installed is spaced from the brackets 18 and 19 by a mounting washer 25 on each of the studs 20.

In accordance with the principles of the present invention, a molded shield 30 is fitted via apertures 29 therein onto the studs 20 of the motor 16 prior to mounting of the motor 16 upon the brackets 18, 19, by fitting the shield 30 over the mounting studs and upon the mounting washers 25. Also assembled with and atop the motor shield 30 is a flexible drape 31, which has an upper portion 32 formed to overlie the shield 30 at one edge thereof and to engage two of the mounting studs 20 as seen in FIG. 2. A major portion 33 of the flexible drape 31 hangs over an edge of the shield 30 so as to be spaced closely adjacent one side of the motor 16, protecting that side of the motor from liquid, particularly liquid splashing up from the floor.

Figure 3:
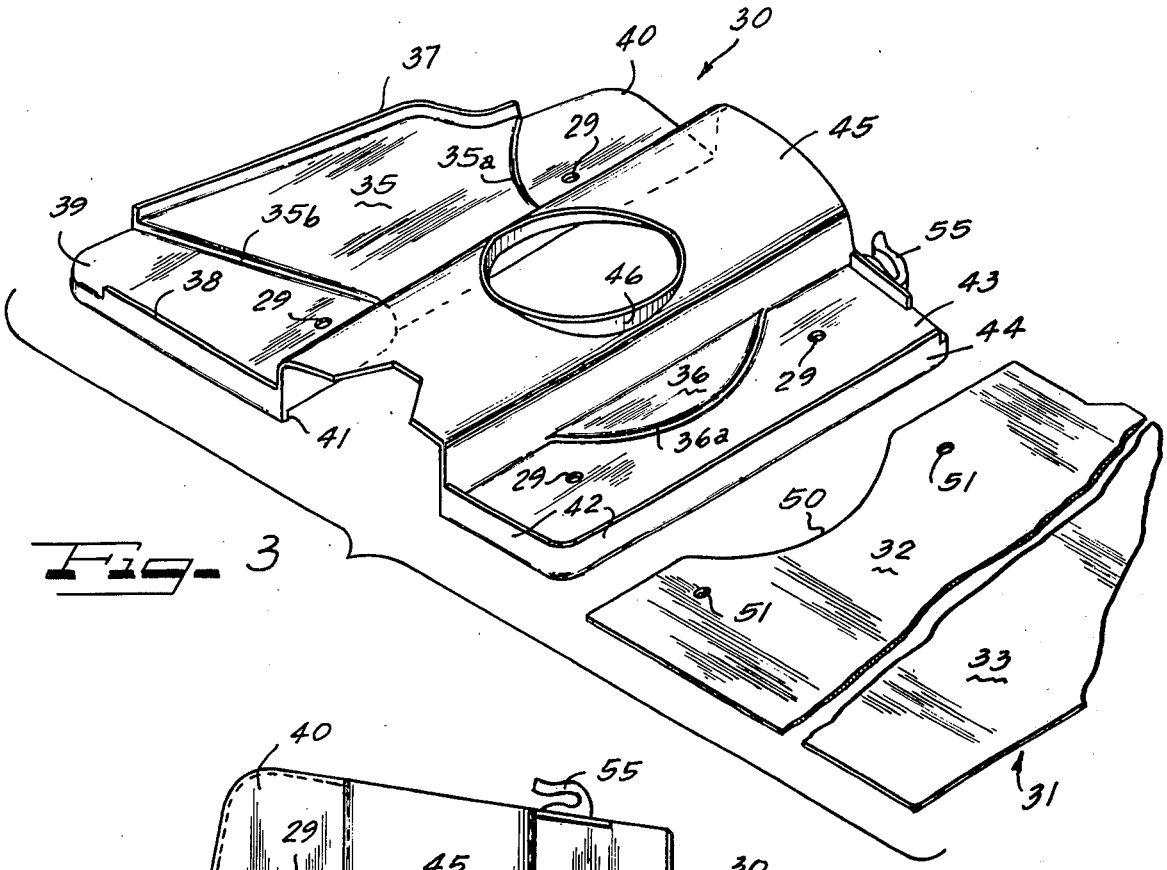
FIG. 3 is an exploded, perspective view of the shield assembly, including the molded shield and the flexible drape.

As depicted in FIG. 3, the molded plastic shield 30 is generally flat, having extended horizontal portions 35, 36. The side portion 35 has raised wall or perimeter portions 37, 38 on two sides thereof. These wall or perimeter portions prevent liquid which falls and collects upon the surface 35 from passing over the edge of the surface at such locations. Rather, water is directed into spillways 39, 40 formed at the corners of the surface by absence of raised perimeter portions. A drip lip 41 extends about the lower portion of the surface 35 beneath the raised perimeter portions 37, 38 and the spillways 39, 40 preventing liquid from dripping back along the underside of the surface 35 and into contact with the motor 16 therebelow. The drip lip 41 also serves to stiffen the surface 35 as do steps **35*a* and 35*b* formed in the surface 35. Similarly, the horizontal portion 36 has a raised perimeter wall portion 42, a single spillway 43 at one corner thereof, and a drip lip 44 about the lower periphery of the surface 36. A step 36*a* stiffens the portion 36**.

Joining the two side portions 35, 36 of the molded shield 30 is a center portion 45 which is raised above the level of the surfaces 35, 36 to avoid a central bearing portion of the housing of the motor 16. The raised portion 45 directs liquid striking it onto the surfaces 35 and 36. At the center of the raised portion 45 is an aperture surrounded by an upstanding annular ridge 46 which encircles the motor shaft 23 with sufficient clearance to form an air passage therethrough to allow adequate air flow to the motor.

As shown in FIG. 3, the flexible drape 31 has an edge 50 at an upper portion 32 thereof arranged to fit the step 36*a* of the side 36 of the molde shield 30. A pair of mounting holes 51, 51 are arranged to pass the mounting studs 20 from the motor 16. The flexible drape 31 may advantageously be made of polyvinylchloride plastic or similar flexible material which will not cause a noise problem when flapped against the motor, base-braces or other machine components during normal machine operation. The shield 30 and drape 31 are shown positioned in FIG. 1 with the drape 31 facing the front of the washing machine. As depicted in FIG. 2, the drape 31 will overlie the perimeter wall 42 of the side 36, so that liquid falling upon the portion 32 thereof will either flow onto the surface 36 or down the outside of the drape 31 along portion 33.

Figure 4:
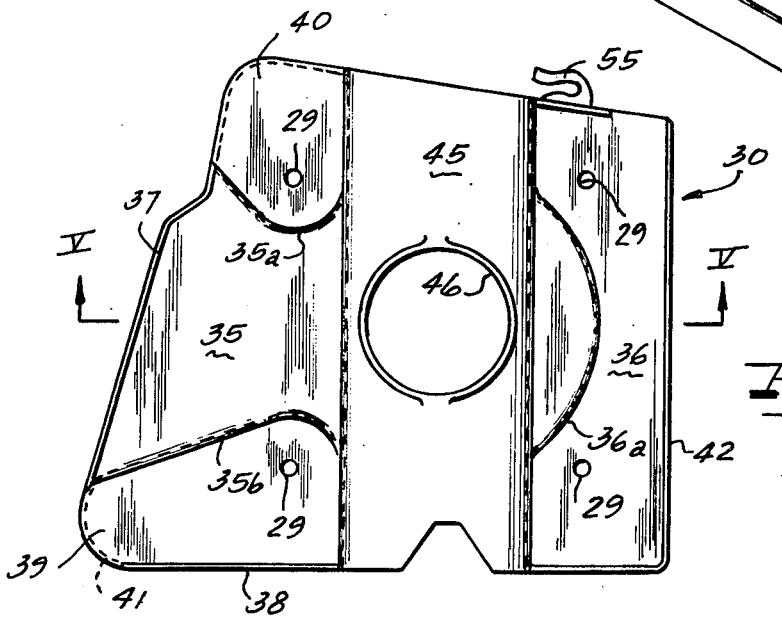
FIG. 4 is a top view of the motor shield of the present invention.
Figure 5:
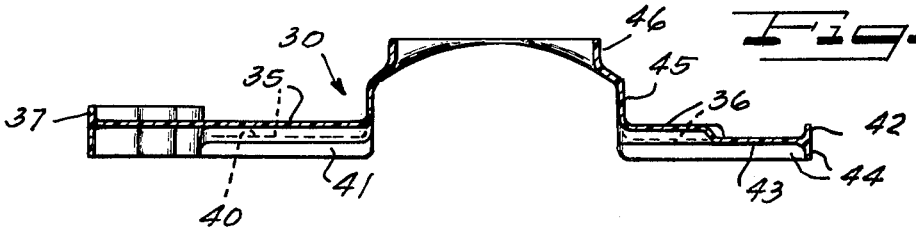
FIG. 5 is a cross-sectional view on line V—V of FIG. 4.

As shown in FIG. 4, the molded shield 30 is further fitted with an electrical wire clamp 55 to hold electric cables in place with respect to the shield, the motor, and the motor mounting brackets, and away from the spillway 43.

Although other various and minor modifications may be suggested by those versed in the art, it should be understood that I wish to embody within the scope of the patent warranted hereon all such modifications as reasonable and properly come within the scope of my contribution to the art.

The embodiments of the invention in which an exclusive property or privilege is claimed are defined as follows:

1. In an appliance having an electric motor and a liquid receptacle mounted generally above said motor, protection means for substantially preventing liquid from said receptacle from contacting said motor, said protection means comprising:

a shield mounted above said motor between said motor and said receptacle, said shield including raised perimeter portions for preventing liquid collected on said shield from contacting said motor, and a flexible drape mounted on one side of said shield and extending downwardly adjacent a side of said motor.

2. In an appliance having an electric motor and a liquid receptacle mounted generally above said motor; protection means for substantially preventing liquid from said receptacle from contacting said motor, said protection means comprising:

a molded plastic shield mounted above a top portion of said motor, said shield including raised perimeter portions for directing liquid collected on said shield toward spillways formed on an upper surface of said shield; and a flexible drape mounted on a side portion of said shield, said drape substantially protecting one side portion of said motor.

3. Protection means means as defined in claim 2 wherein an air passage is formed in said shield for providing air flow to said motor.

4. Protection means as defined in claim 2 wherein said shield includes downwardly extending drip lips along perimeter portions of said shield, said drip lips preventing liquid from flowing around edge portions and along bottom surface portions of said shield toward said motor.

5. In an appliance having an electric motor and a liquid receptacle mounted generally above said motor, protection means for substantially preventing liquid from said receptacle from contacting said motor, said protection means comprising:

a molded plastic shield mounted above a top portion of said motor, said shield including raised perimeter portions for directing liquid collected on said shield toward spillways formed on an upper surface of said shield;

a flexible drape mounted on a side portion of said shield, said drape substantially protecting one side portion of said motor; and wherein said shield includes clip means for retaining electrical wires adjacent said shield.

6. A motor shield assembly for protecting an electric motor from contact with spilling, dripping, and splashing liquid from a liquid receptacle located thereabove, the assembly comprising a formed cover member spaced from and above said motor, said cover member comprising, in combination:

generally horizontal cover surfaces, raised peripheral wall portions, spillways formed in selected edge portions of said member, and a drip lip subjacent said spillways and projecting below said cover surface to collect and dispense liquid away from said motor.

7. A motor shield assembly as defined in claim 6 further comprising:

a flexible drape mounted upon said cover member and overhanging an edge thereof, thereby to be spaced adjacent said motor along a side thereof.

8. A motor shield assembly as defined in claim 6, wherein said assembly is mounted suprajacent said motor upon motor studs attaching said motor to a motor mounting bracket in an appliance.

9. For use in a laundry appliance, a formed cover adapted to overlie an electric drive motor of the appliance, said cover having raised perimeter portions surrounding liquid collection zones and spillways formed to extend through the raised perimeter portions for directing liquid out of the collection zones and away from the motor.

10. For use in a laundry appliance, a cover for overlying and shielding an electric motoe from liquid leakage; and a flexible drape hung alongside the motor from said cover to protect the motor from liquid splashing.

11. The invention as defined in claim 10 wherein the drape is made of a plastic polyvinylchloride material which is substantially noise free when it engages against the motor.

* * * * *